US010927314B2

(12) United States Patent
Ward et al.

(10) Patent No.: US 10,927,314 B2
(45) Date of Patent: Feb. 23, 2021

(54) PROCESS FOR THE CONVERSION OF CRUDE OIL TO PETROCHEMICALS

(71) Applicant: SABIC GLOBAL TECHNOLOGIES B.V., Bergen Op Zoom (NL)

(72) Inventors: Andrew Mark Ward, Geleen (NL); Arno Johannes Maria Oprins, Geleen (NL); Egidius Jacoba Maria Schaerlaeckens, Geleen (NL); Raul Velasco Pelaez, Geleen (NL)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 108 days.

(21) Appl. No.: 16/072,428

(22) PCT Filed: Jan. 27, 2017

(86) PCT No.: PCT/EP2017/051750
§ 371 (c)(1),
(2) Date: Jul. 24, 2018

(87) PCT Pub. No.: WO2017/133975
PCT Pub. Date: Aug. 10, 2017

(65) Prior Publication Data

US 2018/0362866 A1 Dec. 20, 2018

(30) Foreign Application Priority Data

Feb. 5, 2016 (EP) ..... 16154556

(51) Int. Cl.
*C10G 69/06* (2006.01)
*C10G 69/00* (2006.01)
(Continued)

(52) U.S. Cl.
CPC ..... *C10G 69/06* (2013.01); *C10G 7/00* (2013.01); *C10G 69/00* (2013.01); *C10G 69/14* (2013.01);
(Continued)

(58) Field of Classification Search
None
See application file for complete search history.

(56) References Cited

U.S. PATENT DOCUMENTS 3,256,176 A 6/1966 Mills
3,702,292 A 11/1972 Burich
(Continued)

FOREIGN PATENT DOCUMENTS

CN 1620493 5/2005
WO WO 2016/146326 9/1916
(Continued)

OTHER PUBLICATIONS

EIA, Coking is a refinery process that produces 19% of finished petroleum product exports, 2013, available at https://www.eia.gov/todayinenergy/detail.php?id=9731 (retrieved Jun. 11, 2020). (Year: 2013).*

(Continued)

*Primary Examiner* — Derek N Mueller
(74) *Attorney, Agent, or Firm* — Norton Rose Fulbright US LLP

(57) ABSTRACT

An integrated process to convert crude oil into petrochemical products includes distilling crude oil to produce gases fraction, naphtha, kerosene, gasoil and resid; subjecting resid to resid upgrading to produce LPG, light-distillate and middle-distillate; subjecting at least a portion of one or more of the group consisting of middle-distillate produced by resid upgrading, kerosene and gasoil to middle-distillate hydrocracking to produce LPG, light-distillate and hydro-
(Continued)

wax; and subjecting at least a portion of one or more of the group consisting of light-distillate produced by resid upgrading, light-distillate produced by middle-distillate hydrocracking and hydrowax to steam cracking. A process installation for performing the process is also provided.

19 Claims, 1 Drawing Sheet

(51) Int. Cl.

| | |
|---|---|
| ***C10G 69/14*** | (2006.01) |
| ***C10G 7/00*** | (2006.01) |
| *C10G 45/02* | (2006.01) |
| *C10G 47/18* | (2006.01) |

(52) U.S. Cl.

CPC ..... *C10G 45/02* (2013.01); *C10G 47/18* (2013.01); *C10G 2300/1048* (2013.01); *C10G 2400/20* (2013.01); *C10G 2400/22* (2013.01); *C10G 2400/30* (2013.01)

(56) References Cited

U.S. PATENT DOCUMENTS

| | | | | |
|---|---|---|---|---|
| 3,839,484 | A | 10/1974 | Zimmerman et al. | |
| 3,855,113 | A | 12/1974 | Gould | |
| 4,789,457 | A | 12/1988 | Fischer et al. | |
| 5,932,090 | A | 8/1999 | Marchionna et al. | |
| 6,153,087 | A | 11/2000 | Bigeard et al. | |
| 6,270,654 | B1 | 8/2001 | Colyar et al. | |
| 7,214,308 | B2 | 5/2007 | Colyar | |
| 7,513,988 | B2 * | 4/2009 | Oballa | C10G 45/44 208/114 |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2008/0093262 | A1 | 4/2008 | Gragnani et al. | |
| 2012/0234726 | A1 | 9/2012 | Morel et al. | |
| 2013/0267745 | A1 * | 10/2013 | Schrod | C10B 57/045 585/303 |
| 2014/0299515 | A1 | 10/2014 | Weiss et al. | |
| 2016/0122666 | A1 | 5/2016 | Weiss et al. | |

FOREIGN PATENT DOCUMENTS

| | | | | |
|---|---|---|---|---|
| WO | WO 2014/095813 | | 1/2014 | |
| WO | WO 2014/142874 | | 9/2014 | |
| WO | WO 2015/000841 | | 1/2015 | |
| WO | WO 2015/000848 | | 1/2015 | |
| WO | WO 2015/128018 | | 9/2015 | |
| WO | WO2015/128036 | * | 9/2015 | C10G 65/10 |

OTHER PUBLICATIONS

Office Action issued in corresponding European Application No. 17703071.5, dated Sep. 6, 2019.

Alfke et al., "Oil Refining" *Ullmann's Encyclopedia of Industrial Chemistry*, 2012, 25:208-260.

International Search Report and Written Opinion issued in International Patent Application No. PCT/EP2017/051750, dated May 29, 2017.

Office Action issued in corresponding Chinese Patent Application No. 201780022067.7, dated Jun. 19, 2020.

* cited by examiner

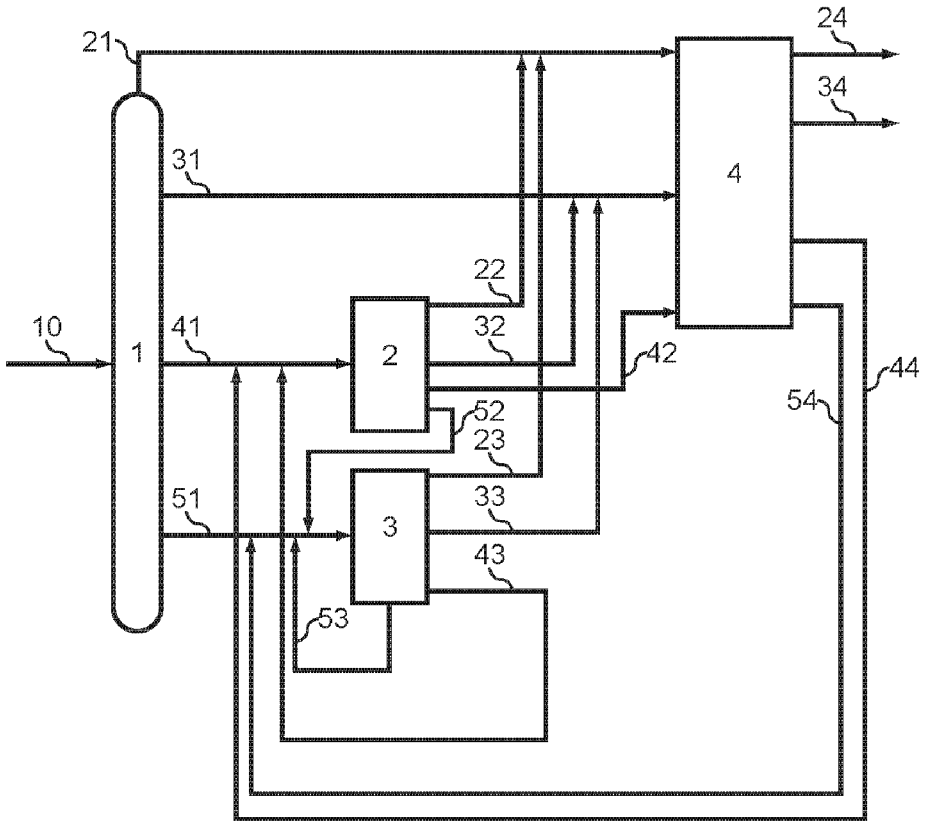
21
24
34
31
4
22
10
41
32
1
2
42
44
52
54
23
51
33
3
43
53

PROCESS FOR THE CONVERSION OF CRUDE OIL TO PETROCHEMICALS

CROSS REFERENCE TO RELATED APPLICATIONS

This application is a national phase under 35 U.S.C. § 371 of International Application No. PCT/EP2017/051750, filed Jan. 27, 2017, which claims the benefit of priority of European Patent Application No. 16154556.1, filed Feb. 5, 2016. The entire contents of each of the above-referenced applications are incorporated into the present application by reference.

The present invention relates to an integrated process to convert crude oil into petrochemical products comprising crude oil distillation, hydrocracking and steam cracking, which process comprises subjecting the crude oil to crude oil distillation to produce gases fraction, naphtha, kerosene, gasoil and resid; subjecting resid to resid upgrading to produce LPG, light-distillate and middle-distillate; subjecting at least a portion of one or more of the group consisting of middle-distillate produced by resid upgrading, kerosene and gasoil to middle-distillate hydrocracking to produce LPG, light-distillate and hydrowax; and subjecting at least a portion of one or more of the group consisting of light-distillate produced by resid upgrading, light-distillate produced by middle-distillate hydrocracking and hydrowax to steam cracking. Furthermore, the present invention relates to a process installation for performing the process of the present invention. The process and process installation of the present invention allows the conversion of crude oil into petrochemical products having an improved carbon-efficiency, while maintaining a high ethylene yield and a favourable ethylene:propylene ratio.

Processes for converting crude oil into petrochemical products have been previously described. For instance, WO 2015/000848 A1 describes an integrated process to convert crude oil into petrochemical products comprising crude oil distillation, hydrocracking and olefins synthesis, which process comprises subjecting a hydrocracker feed to hydrocracking to produce LPG and BTX and subjecting the LPG produced in the process to olefins synthesis. Furthermore, WO 2015/000848 A1 describes a process installation to convert crude oil into petrochemical products comprising: a crude distillation unit comprising an inlet for crude oil and at least one outlet for one or more of naphtha, kerosene and gasoil; a hydrocracker comprising an inlet for a hydrocracker feed, an outlet for LPG and an outlet for BTX; and a unit for olefins synthesis comprising an inlet for LPG produced by the integrated petrochemical process installation and an outlet for olefins. The hydrocracker feed used in the process and the process installation of the present invention comprises one or more of naphtha, kerosene and gasoil produced by crude oil distillation in the process; and refinery unit-derived light-distillate and/or refinery unit-derived middle-distillate produced in the process. The process of WO 2015/000848 A1 is characterized in that the crude oil is hydrocracked to produce LPG, which is subjected to olefins synthesis, preferably pyrolysis of ethane, dehydrogenation of propane and dehydrogenation of butane. WO 2015/000848 A1 does not specifically describe subjecting at least a portion of one or more of the group consisting of light-distillate produced by resid upgrading, light-distillate produced by middle-distillate hydrocracking and hydrowax to steam cracking.

It was an object of the present invention to provide an improved process for converting crude oil into petrochemical products, preferably C2-C4 olefins and BTX, which combines a high carbon efficiency with a high ethylene yield and a favourable ethylene:propylene molar ratio of more than 1. It was further an object of the present invention to provide an improved process for converting convert crude oil into petrochemical products having a high carbon efficiency in combination with an improved butadiene yield. It was further an object of the present invention to provide an improved process for converting convert crude oil into petrochemical products having a high carbon efficiency in combination with an improved benzene yield.

The solution to the above problem is achieved by providing the embodiments as described herein below and as characterized in the claims.

In one aspect, the present invention relates to an integrated process to convert crude oil into petrochemical products. This process is also presented in FIG. 1 which is further described herein below.

Accordingly, the present invention provides a process to convert crude oil into petrochemical products comprising crude oil distillation, hydrocracking and steam cracking, which process comprises:

(a) subjecting the crude oil to crude oil distillation to produce gases fraction, naphtha, kerosene, gasoil and resid;

(b) subjecting resid to resid upgrading to produce LPG, light-distillate and middle-distillate;

(c) subjecting at least a portion of one or more of the group consisting of middle-distillate produced by resid upgrading, kerosene and gasoil to middle-distillate hydrocracking to produce LPG, light-distillate and hydrowax; and (d) subjecting at least a portion of one or more of the group consisting of light-distillate produced by resid upgrading, light-distillate produced by middle-distillate hydrocracking and hydrowax to steam cracking.

In the context of the present invention, it was surprisingly found that a very favourable combination of a high carbon efficiency in combination with a relatively high yield in valuable petrochemical products can be obtained. WO 2015/000848 A1 provides processes having an improved carbon efficiency, but these processes are also characterized in that the ethylene yield is reduced and/or that the ethylene:propylene molar ratio has a less desired value, such as a etlylene:propylene molar ratio of less than 1 and/or that the butadiene yield is reduced and/or that the benzene yield is reduced.

The prior art describes processes for producing petrochemical products from specific hydrocarbon feeds such as specific crude oil fractions and/or refinery unit-derived distillates. WO 2015/000841 A1, e.g. describes a process for upgrading refinery heavy residues to petrochemicals, comprising the following steps of: (a) separating a hydrocarbon feedstock in a distillation unit into a to overhead stream and a bottom stream (b) feeding said bottom stream to a hydrocracking reaction area (c) separating reaction products, which are generated from said reaction area of step (b) into a stream rich in mono-aromatics and in a stream rich in poly-aromatics (d) feeding said stream rich in mono-aromatics to a gasoline hydrocracker unit, (e) feeding said stream rich in poly-aromatics to a ring opening reaction area. WO 2015/000841 A1 does not describe a process wherein one or more of the group consisting of middle-distillate produced by resid upgrading, kerosene and gasoil is subjected to middle-distillate hydrocracking to produce, inter alia, hydrowax and that said hydrowax may be subjected to steam cracking. WO 2015/000841 A1 also does not describe a process wherein light-distillate produced by middle-distillate hydrocracking is subjected to steam cracking. WO 2015/000841 A1 merely describes that the light fraction formed in the reaction area for ring opening, which is further described therein to represent LPG, may be subjected to steam cracking. The heavy fraction of reaction products formed in the reaction area for ring opening, which is defined in WO 2015/000841 A1 to represent the ARO-gasoline and which is in the light-distillate boiling point range, is subjected to the gasoline hydrocracker, and not to the steam cracker.

U.S. Pat. No. 3,702,292 describes an integrated crude oil refinery arrangement for producing fuel and chemical products, involving crude oil distillation means, hydrocracking means, delayed coking means, reforming means, ethylene and propylene producing means comprising a pyrolysis steam cracking unit and a pyrolysis products separation unit, catalytic cracking means, aromatic product recovery means, butadiene recovery means and alkylation means in an interrelated system to produce a conversion of crude oil to petrochemicals of about 50% and a conversion of crude oil to fuels of about 50%. U.S. Pat. No. 3,702,292 does not describe a process wherein middle-distillate produced by resid upgrading is subjected to middle-distillate hydrocracking. U.S. Pat. No. 3,702,292 also does not describe a process wherein the middle-distillate hydrocracking produces hydrowax that may be subjected to steam cracking.

U.S. Pat. No. 3,839,484 describes a process for the preparation of unsaturated hydrocarbons by pyrolysis of naphthas in a pyrolysis furnace comprising hydrocracking said naphthas to form a mixture of paraffins and isoparaffins said mixture consisting essentially of hydrocarbons containing from 1 to about 7 carbon atoms per molecule and pyrolyzing the resulting mixture of paraffins and isoparaffins in said pyrolysis furnace. U.S. Pat. No. 3,839,484 fails to describe a process wherein resid is subjected to resid upgrading to produce LPG, light-distillate and middle-distillate. U.S. Pat. No. 3,839,484 fails to describe a process wherein at least a portion of one or more of the group consisting of middle-distillate produced by resid upgrading, kerosene and gasoil to middle-distillate hydrocracking to produce LPG, light-distillate and hydrowax. U.S. Pat. No. 3,839,484 also does not describe subjecting hydrowax to steam cracking.

The term "crude oil" as used herein refers to the petroleum extracted from geologic formations in its unrefined form. The term crude oil will also be understood to include that which has been subjected to water-oil separations and/or gas-oil separation and/or desalting and/or stabilization. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands, gas condensates and bio-based oils. The crude oil used as feed to the process of the present invention preferably is conventional petroleum having an API gravity of more than 20° API as measured by the ASTM D287 standard. More preferably, the crude oil used in the process of the present invention is a light crude oil having an API gravity of more than 30° API. Most preferably, the crude oil used in the process of the present invention comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "gases produced by the crude distillation unit" or "gases fraction" as used herein refers to the fraction obtained in a crude oil distillation process that is gaseous at ambient temperatures. Accordingly, the "gases fraction" derived by crude distillation mainly comprises C1-C4 hydrocarbons and may further comprise impurities such as hydrogen sulfide and carbon dioxide. In this specification, other petroleum fractions obtained by crude oil distillation are referred to as "naphtha", "kerosene", "gasoil" and "resid". The terms naphtha, kerosene, gasoil and resid are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between the different crude oil distillation fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C. Preferably, the term "resid" as used herein relates to the petroleum fraction obtained by crude oil distillation having a boiling point of more than about 340° C., more preferably of more than about 350° C.

As used herein, the term "refinery unit" relates to a section of a petrochemical plant complex for the chemical conversion of crude oil to petrochemicals and fuels. In this respect, it is to be noted that a unit for olefins synthesis, such as a steam cracker, is also considered to represent a "refinery unit". In this specification, different hydrocarbons streams produced by refinery units or produced in refinery unit operations are referred to as: refinery unit-derived gases, refinery unit-derived light-distillate, refinery unit-derived middle-distillate and refinery unit-derived heavy-distillate. Accordingly, a refinery unit derived distillate is obtained as the result of a chemical conversion followed by a separation, e.g. by distillation or by extraction, which is in contrast to a crude oil fraction. The term "refinery unit-derived gases" relates to the fraction of the products produced in a refinery unit that is gaseous at ambient temperatures. Accordingly, the refinery unit-derived gas stream may comprise gaseous compounds such as LPG and methane. Other components comprised in the refinery unit-derived gas stream may be hydrogen and hydrogen sulfide. The terms light-distillate, middle-distillate and heavy-distillate are used herein having their generally accepted meaning in the field of petroleum refinery processes; see Speight, J. G. (2005) loc.cit. In this respect, it is to be noted that there may be overlap between different distillation fractions due to the complex mixture of the hydrocarbon compounds comprised in the product stream produced by refinery unit operations and the technical limits to the distillation process used to separate the different fractions. Preferably, the refinery-unit derived light-distillate is the hydrocarbon distillate obtained in a refinery unit process having a boiling point range of about 20-200° C., more preferably of about 30-190° C. The "light-distillate" is often relatively rich in aromatic hydrocarbons having one aromatic ring. Preferably, the refinery-unit derived middle-distillate is the hydrocarbon distillate obtained in a refinery unit process having a boiling point range of about 180-360° C., more preferably of about 190-350° C. The "middle-distillate" is relatively rich in aromatic hydrocarbons having two aromatic rings. Preferably, the refinery-unit derived heavy-distillate is the hydrocarbon distillate obtained in a refinery unit process having a boiling point of more than about 340° C., more preferably of more than about 350° C. The "heavy-distillate" is relatively rich in hydrocarbons having condensed aromatic rings.

The term "alkane" or "alkanes" is used herein having its established meaning and accordingly describes acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes") and branched alkanes ("iso-paraffins" or "iso-alkanes") but excludes naphthenes (cycloalkanes).

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekulé structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly describes saturated cyclic hydrocarbons.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

One of the petrochemical products produced in the process of the present invention is BTX. The term "BTX" as used herein relates to a mixture of benzene, toluene and xylenes. Preferably, the product produced in the process of the present invention comprises further useful aromatic hydrocarbons such as ethylbenzene. Accordingly, the present invention preferably provides a process for producing a mixture of benzene, toluene xylenes and ethylbenzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethylbenzene product stream.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

The process of the present invention involves crude distillation, which comprises separating different crude oil fractions based on a difference in boiling point. As used herein, the term "crude distillation unit" or "crude oil distillation unit" relates to the fractionating column, or a combination of more than one fractionation column, that is used to separate crude oil into fractions by fractional distillation; see Alfke et al. (2007) loc.cit. Preferably, the crude oil is processed in an atmospheric distillation unit to separate gas oil and lighter fractions from higher boiling components (atmospheric residuum or "resid"). In the present invention, it is not essential to pass the resid to a vacuum distillation unit for further fractionation of the resid, and it is possible to process the resid as a single fraction. In case of relatively heavy crude oil feeds or in case slurry resid hydrocracking is to be used, it may be advantageous to further fractionate the resid using a vacuum distillation unit to further separate the resid into a vacuum gas oil fraction and vacuum residue fraction. In case vacuum distillation is used, the vacuum gas oil fraction and vacuum residue fraction may be processed separately in the subsequent refinery units. For instance, the vacuum residue fraction may be specifically subjected to solvent deasphalting before further processing. Preferably, the term "vacuum gas oil" as used herein relates to the petroleum fraction obtained by crude oil distillation having a having a boiling point range of about 340-560° C., more preferably of about 350-550° C. Preferably, the term "vacuum resid" as used herein relates to the petroleum fraction obtained by crude oil distillation having a boiling point of more than about 540° C., more preferably of more than about 550° C.

As used herein, the term "hydrocracker unit" or "hydrocracker" relates to a refinery unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons, naphthenic (cycloalkane) hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-20 MPa, space velocities between 0.1-10 $h^{-1}$. Hydrocracking reactions proceed through a bifunctional mechanism which requires an acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by combining various transition metals, or metal sulfides with the solid support such as alumina, silica, alumina-silica, magnesia and zeolites.

The process of the present invention accordingly involves subjecting at least a portion of one or more of the group consisting of middle-distillate produced by resid upgrading, kerosene and gasoil to middle-distillate hydrocracking to produce LPG, light-distillate and hydrowax. Preferably, the process of the present invention involves subjecting at least a portion of the middle-distillate produced by resid upgrading and kerosene and gasoil to middle-distillate hydrocracking to produce LPG, light-distillate and hydrowax. "The "middle-distillate hydrocracking unit" refers to a refinery unit wherein a specific hydrocracking process is performed that is particularly suitable for converting a feed having a boiling point in the kerosene and gasoil boiling point range, and optionally also in the vacuum gasoil boiling point range, to produce LPG and a light-distillate (hydrocracked naphtha) and, depending on the specific process and/or process conditions, hydrowax. Such a middle-distillate hydrocracking process is for instance described in U.S. Pat. Nos. 3,256,176 and 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt-% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. In the context of the present invention, it is preferred to use an aromatic ring opening process that is optimized for producing hydrowax. The term "hydrowax" is very well known in the art and relates to the paraffinic fraction produced by hydrocracking having a boiling point range of about 190-560° C., preferably 200-550° C. Preferably, the hydrowax has a hydrogen content of at least 13.5 wt-%, more preferably a hydrogen content of at least 14.0 wt-%. Such a middle-distillate hydrocracking process for optimized for producing hydrowax is for instance described in WO2014/095813 A1.

Accordingly, the process of the present invention involves subjecting at least a portion of one or more of the group consisting of light-distillate produced by resid upgrading, light-distillate produced by middle-distillate hydrocracking and hydrowax to steam cracking. Preferably, the process of the present invention involves subjecting at least a portion of the light-distillate produced by resid upgrading and the light-distillate produced by middle-distillate hydrocracking and the hydrowax to steam cracking. As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas steam cracking) or liquid hydrocarbon feeds like naphtha, gasoil and hydrowax (liquid steam cracking) are diluted with steam and briefly heated in a furnace without the presence of oxygen. Typically, the reaction temperature is 750-900° C. and the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger and/or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where a heavy-distillate produced by steam cracking ("carbon black oil") and a middle-distillate produced by steam cracking ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases ($CO_2$ and $H_2S$) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the steam cracking process. Preferably, the steam cracking process step used in the process of the present invention includes both liquid steam cracking, including steam cracking of hydrowax, and gas steam cracking. The different gaseous steam cracker feeds and liquid steam cracker feeds are preferably subjected to steam cracking in dedicated furnaces that are optimized towards their respective feeds. Hence, the ethane is preferably subjected to steam cracking in a ethane steam cracker furnace, the hydrowax is preferably subjected to steam cracking in a hydrowax steam cracker furnace, etc.

As used herein, the term "resid upgrading unit" relates to a refinery unit suitable for the process of resid upgrading, which is a process for breaking the hydrocarbons comprised in the resid and/or refinery unit-derived heavy-distillate into lower boiling point hydrocarbons; see Alfke et al. (2007) loc.cit. Commercially available technologies include a delayed coker, a fluid coker, a resid FCC, a Flexicoker, a visbreaker or a catalytic hydrovisbreaker. Preferably, the resid upgrading unit may be a coking unit or a resid hydrocracker. A "coking unit" is an oil refinery processing unit that converts resid into LPG, light-distillate, middle-distillate, heavy-distillate and petroleum coke. The process thermally cracks the long chain hydrocarbon molecules in the residual oil feed into shorter chain molecules.

The feed to resid upgrading preferably comprises resid and heavy-distillate produced in the process, but excluding the hydrowax produced in the process. Such heavy-distillate may comprise the heavy-distillate produced by a steam cracker, such as carbon black oil and/or cracked distillate but may also comprise the heavy distillate produced by resid upgrading, which may be recycled to extinction. Yet, a relatively small pitch stream may be purged from the process.

Preferably, the resid upgrading is resid hydrocracking, more preferably, the resid upgrading is slurry resid hydrocracking.

By selecting resid hydrocracking over other means for resid upgrading, the carbon efficiency of the process of the present invention can be vastly improved, while maintaining an acceptable hydrogen consumption.

A "resid hydrocracker" is an oil refinery processing unit that is suitable for the process of resid hydrocracking, which is a process to convert resid into LPG, light distillate, middle-distillate and heavy-distillate. Resid hydrocracking processes are well known in the art; see e.g. Alfke et al. (2007) loc.cit. Accordingly, 3 basic reactor types are employed in commercial hydrocracking which are a fixed bed (trickle bed) reactor type, an ebullated bed reactor type and slurry (entrained flow) reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated bed hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. Slurry resid hydrocracking processes represent a combination of thermal cracking and catalytic hydrogenation to achieve high yields of distillable products from heavy resid feeds that are often highly contaminated. Such slurry resid hydrocracking processes are well-described in the prior art; see e.g. U.S. Pat. No. 5,932,090, US 2012/0234726 A1 and WO 2014142874 A1. In the first liquid stage, thermal cracking and hydrocracking reactions occur simultaneously in the bubble slurry phase at process conditions that include a temperature of 400-500° C. and a pressure of 15-25 MPa gauge. Resid, hydrogen and catalyst are introduced at the bottom of the reactor and a bubble slurry phase is formed, the height of which depends on flow rate and desired conversion. In these processes catalyst is continuously replaced to achieve consistent conversion levels through an operating cycle. The catalyst may be an unsupported metal sulfide that is generated in situ within the reactor. In practice the additional costs associated with the ebullated bed and slurry phase reactors are only justified when a high conversion of highly contaminated heavy streams such as vacuum gas oils is required. Under these circumstances the limited conversion of very large molecules and the difficulties associated with catalyst deactivation make fixed bed processes relatively unattractive in the process of the present invention. Accordingly, ebullated bed and slurry reactor types are preferred due to their improved yield of light- and middle-distillate when compared to fixed bed hydrocracking. As used herein, the term "resid upgrading liquid effluent" relates to the product produced by resid upgrading excluding the gaseous products, such as methane and LPG and the heavy distillate produced by resid upgrading. The heavy-distillate produced by resid upgrading is preferably recycled to the resid upgrading unit until extinction. However, it may be necessary to purge a relatively small pitch stream. From the viewpoint of carbon efficiency, a resid hydrocracker is preferred over a coking unit as the latter produces considerable amounts of petroleum coke that cannot be upgraded to high value petrochemical products. From the viewpoint of the hydrogen balance of the integrated process, it may be preferred to select a coking unit over a resid hydrocracker as the latter leads to a higher consumption of hydrogen in the integrated process. Also in view of the capital expenditure and/or the operating costs it may be advantageous to select a coking unit over a resid hydrocracker.

In case the resid is further fractionated using a vacuum distillation unit to separate the resid into a vacuum gas oil fraction and vacuum residue fraction, it is preferred to subject the vacuum gasoil to middle-distillate hydrocracking and the vacuum resid to resid hydrocracking, wherein the heavy-distillate and the middle-distillate produced by resid hydrocracking is subsequently subjected to middle-distillate hydrocracking. In case the present invention involves vacuum distillation, the vacuum gasoil thus obtained is preferably fed to the middle-distillate hydrocracking unit together with one or more other hydrocarbon streams that have a boiling point in the kerosene and gasoil boiling point range. The resid hydrocracking preferably is slurry resid hydrocracking as defined herein above. In case slurry resid hydrocracking is selected as resid upgrading, the resid obtained by crude distillation is preferably subjected to vacuum distillation to separate the resid into vacuum gasoil and vacuum resid, wherein only the vacuum resid is subjected to slurry resid hydrocracking. The thus obtained vacuum gasoil is subjected to middle-distillate hydrocracking as described herein.

Preferably, at least a portion of one or more selected from the group consisting of the gases fraction, LPG produced by resid upgrading and LPG produced by middle-distillate hydrocracking is subjected to steam cracking. By subjecting the gases fraction and the LPG produced in the process the ethylene yield of the process is further improved, while also reducing the overall hydrogen consumption since gas steam cracking produces considerable amounts of hydrogen, which can be used in the upstream hydrocracking process steps.

Preferably, at least a portion of the naphtha is subjected to steam cracking. By subjecting the naphtha produced by crude distillation to steam cracking, the ethylene yield and the ethylene:propylene ratio of the overall process of the present can be further improved. Furthermore, the overall hydrogen consumption of the integrated process of the present invention can be reduced since naphtha steam cracking produces considerable amounts of hydrogen, which can be used in the upstream hydrocracking process steps.

The middle-distillate hydrocracking may further produce a heavy-distillate, wherein at least a portion of said heavy-distillate produced by middle-distillate hydrocracking may be subjected to resid upgrading. In the event that the hydrogen content of the heavy-distillate produced by middle-distillate hydrocracking is high enough, preferably having a hydrogen content of at least 13.5 wt-%, more preferably having a hydrogen content of at least 14.0 wt-%, the heavy-distillate produced by middle-distillate hydrocracking is subjected to steam cracking as hydrowax. Accordingly, the process conditions of the middle-distillate hydrocracking are selected as such that the hydrogen content of the heavy-distillate produced is high enough so that it can be subjected to steam cracking instead of recycling to the resid upgrading.

Preferably, the steam cracking produces a middle-distillate, wherein at least a portion of said middle-distillate produced by steam cracking is subjected to middle-distillate hydrocracking. It is an advantage of the process of the present invention that the a middle-distillate produced by steam cracking ("cracked distillate") which normally represents only limited value can be upgraded to high-value petrochemicals by subjecting said cracked distillate to middle-distillate hydrocracking.

Preferably, the steam cracking produces a heavy-distillate, wherein at least a portion of said heavy-distillate produced by steam cracking is subjected to resid upgrading.

It is an advantage of the process of the present invention that the a heavy-distillate produced by steam cracking ("carbon black oil") which normally represents only limited value can be upgraded to high-value petrochemicals by subjecting said carbon black oil to resid upgrading. Particularly slurry resid hydrocracking is suitable for converting carbon black oil into middle-distillate, light distillate and LPG which can be further processed to provide a suitable steam cracker feedstock or which can be directly used as a steam cracker feedstock to provide high-value chemicals.

In the process of the present invention resid is subjected to resid upgrading to produce LPG, light-distillate and middle-distillate, wherein at least a portion of the thus obtained middle-distillate is subjected to middle-distillate hydrocracking to produce LPG, light-distillate and hydrowax. At least a portion of the resid is thus upgraded in the process of the present invention to LPG, light-distillate and hydrowax that is subsequently subjected to steam cracking. In the process of the present invention, at least 20 wt-% of the total feed to the resid upgrading may be converted to LPG, light-distillate and hydrowax that is subjected to steam cracking.

Preferably, at least 30 wt-%, more preferably at least 40 wt-%, even more preferably at least 50 wt-%, particularly preferably at least 60 wt-%, more particularly preferably at least 70 wt-% and most preferably at least 80 wt-% of the total feed to the resid upgrading is upgraded to LPG, light-distillate and hydrowax that is subjected to steam cracking.

In the process of the present invention, at least 40 wt-% of the combined light-distillate produced by resid upgrading and light-distillate produced by middle-distillate hydrocracking may be subjected to steam cracking. Preferably, at least 50 wt-%, more preferably at least 60 wt-%, even more preferably at least 70 wt-%, particularly preferably at least 80 wt-%, more particularly preferably at least 90 wt-% and most preferably at least 95 wt-% of the combined light-distillate produced by resid upgrading and light-distillate produced by middle-distillate hydrocracking is subjected to steam cracking.

In a further aspect, the present invention also relates to a process installation suitable for performing the process of the invention. This process installation and the process as performed in said process installation is presented in FIG. 1 (FIG. 1).

Accordingly, the present invention provides a process installation installation to convert crude oil into petrochemical products comprising a crude distillation unit (1) comprising an inlet for crude oil (10), an outlet for gases fraction (21), an outlet for naphtha (31), an outlet for kerosene and/or gasoil (41) and an outlet for resid (51);

a resid upgrading unit (3) comprising an inlet and an outlet for LPG (23), an outlet for light-distillate (33) and an outlet for middle-distillate (43);

a middle-distillate hydrocracking unit (2) comprising an inlet and an outlet for LPG (22), an outlet for light-distillate (32) and an outlet for hydrowax (42); and a steam cracking unit (4), wherein at least a portion of one or more of the group consisting of the middle-distillate produced by resid upgrading (43) and kerosene and/or gasoil (41) is fed to the inlet to the middle-distillate hydrocracking unit and wherein at least a portion of one or more of the group consisting of the light-distillate produced by resid upgrading (33), light-distillate produced by middle-distillate hydrocracking (32) and hydrowax (42) is fed to the steam cracking unit (4).

As used herein, the term "an inlet for X" or "an outlet of X", wherein "X" is a given hydrocarbon fraction or the like relates to an inlet or outlet for a stream comprising said hydrocarbon fraction or the like. In case of an outlet for X is directly connected to a downstream refinery unit comprising an inlet for X, said direct connection may comprise further units such as heat exchangers, separation and/or purification units to remove undesired compounds comprised in said stream and the like.

If, in the context of the present invention, a refinery unit is fed with more than one feed stream, said feedstreams may be combined to form one single inlet into the refinery unit or may form separate inlets to the refinery unit.

Preferably, the resid upgrading unit (3) is a resid hydrocracking unit, most preferably a slurry resid hydrocracking unit.

Preferably, at least a portion of one or more selected from the group consisting of the gases fraction (21), LPG produced by resid upgrading (23) and LPG produced by middle-distillate hydrocracking (22) is fed to the steam cracking unit (4).

Preferably, at least a portion of the naphtha (31) is fed to the steam cracking unit (4).

Preferably, the middle-distillate hydrocracking unit (2) comprises a further outlet for a heavy-distillate (52) wherein at least of a portion of the heavy-distillate (52) is fed to the resid upgrading unit (3).

Preferably, the steam cracking unit (4) comprises a further outlet for a middle-distillate (44), wherein at least a portion of the middle-distillate (44) is fed to the middle-distillate hydrocracking unit (2).

Preferably, the steam cracking unit (4) comprises a further outlet for a heavy-distillate (54), wherein at least a portion of the heavy-distillate (54) is fed to the resid upgrading unit (3).

The process of the present invention may require removal of sulfur from certain crude oil fractions to prevent catalyst deactivation in downstream refinery processes, such as hydrocracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

In the process and the process installation of the present invention, all methane produced is collected and preferably subjected to a separation process to provide fuel gas. Said fuel gas is preferably used to provide the process heat in the form of hot flue gases produced by burning the fuel gas or by forming steam. Alternatively, the methane can be subjected to steam reforming to produce hydrogen. Also the undesired side products produced by e.g. steam cracking may be recycled. For instance, the cracked distillate produced by steam cracking may be recycled to middle-distillate hydrocracking, whereas the carbon black oil may be recycled to the resid upgrading.

Preferably, the gases fraction produced by the crude distillation unit and the refinery unit-derived gases are subjected to gas separation to separate the different components, for instance to separate methane from LPG.

As used herein, the term "gas separation unit" relates to the refinery unit that separates different compounds comprised in the gases produced by the crude distillation unit and/or refinery unit-derived gases. Compounds that may be separated to separate streams in the gas separation unit comprise ethane, propane, butanes, hydrogen and fuel gas mainly comprising methane. Any conventional method suitable for the separation of said gases may be employed in the context of the present invention. Accordingly, the gases may be subjected to multiple compression stages wherein acid gases such as $CO_2$ and $H_2S$ may be removed between compression stages. In a following step, the gases produced may be partially condensed over stages of a cascade refrigeration system to about where only the hydrogen remains in the gaseous phase. The different hydrocarbon compounds may subsequently be separated by distillation.

The different units operated in the process or the process installation of the present invention are furthermore integrated by feeding the hydrogen produced in certain processes, such as in olefins synthesis, as a feedstream to processes that need hydrogen as a feed, such as in hydrocracking. In case the process and the process installation is a net consumer of hydrogen (i.e. during start-up of the process or the process installation or because all hydrogen consuming processes consume more hydrogen than produced by all hydrogen producing processes), reforming of additional methane or fuel gas than the fuel gas produced by the process or the process installation of the present invention may be required.

The following numerical references are used in FIG. 1:

1 crude distillation unit
2 middle-distillate hydrocracking unit
3 resid upgrading unit
4 steam cracking unit
10 crude oil
21 gases fraction
22 LPG produced by middle-distillate hydrocracking
23 LPG produced by resid upgrading
24 C2-C4 olefins
31 naphtha
32 light-distillate produced by middle-distillate hydrocracking
33 light-distillate produced by resid upgrading
34 BTX
41 kerosene and/or gasoil
42 hydrowax
43 middle-distillate produced by resid upgrading
44 middle-distillate produced by steam cracking
51 resid
52 heavy-distillate produced by middle-distillate hydrocracking
53 heavy-distillate produced by resid upgrading
54 heavy-distillate produced by steam cracking Although the invention has been described in detail for purposes of illustration, it is understood that such detail is solely for that purpose and variations can be made therein by those skilled in the art without departing from the spirit and scope of the invention as defined in the claims.

It is further noted that the invention relates to all possible combinations of features described herein, preferred in particular are those combinations of features that are present in the claims.

It is noted that the term "comprising" does not exclude the presence of other elements. However, it is also to be understood that a description on a product comprising certain components also discloses a product consisting of these components. Similarly, it is also to be understood that a description on a process comprising certain steps also discloses a process consisting of these steps.

The present invention will now be more fully described by the following non-limiting Examples.

EXAMPLE 1 (COMPARATIVE)

The experimental data as provided herein were obtained by flowsheet modelling in Aspen Plus. The steam cracking kinetics were taken into account rigorously (software for steam cracker product slate calculations). The following steam cracker furnace conditions were applied for Examples 1 and 2: ethane and propane furnaces: coil outlet temperature (COT)=845° C. and steam-to-oil-ratio=0.37, C4-furnaces and liquid furnaces: COT=820° C. and Steam-to-oil-ratio=0.37. For the gasoline hydrocracking, a reaction scheme has been used that is based on experimental data reported in literature. For middle-distillate hydrocracking followed by gasoline hydrocracking according to WO 2015/000848 A1. a reaction scheme has been used in which all multi aromatic compounds were converted into BTX and LPG and all naphthenic and paraffinic compounds were converted to LPG. The product slates from propane dehydrogenation and butane dehydrogenation were based on literature data. The resid hydrocracker was modelled based on data from literature.

In Example 1, which is according to Example 3 of WO 2015/000848 A1, Arabian light crude oil is distilled in an atmospheric distillation unit to provide a gases fraction, a naphtha fraction, a kerosene/gasoil fraction and a resid fraction. First, the naphtha fraction is subjected to feed hydrocracking to yield BTX (product) and LPG (intermediate). The kerosene and gas oil fractions are subjected to middle-distillate hydrocracking which is operated under process conditions to maintain 1 aromatic ring. The effluent from this middle-distillate hydrocracking unit is further treated in the gasoline hydrocracker to yield BTX (product) and LPG (intermediate). The resid is upgraded in a resid hydrocracker to produce LPG, light-distillate and middle-distillate. The light-distillate produced by resid hydrocracking is fed to the feed hydrocracker to yield BTX (product) and LPG (intermediate). The middle-distillate produced by resid hydrocracking is subjected to middle-distillate hydrocracking that is operated under process conditions to maintain 1 aromatic ring. The effluent from the middle-distillate hydrocracker is further treated in the gasoline hydrocracker to yield BTX and LPG. The gases fraction and the LPG produced by the various units is separated into ethane-, propane- and butane fractions, wherein the propane and butane are dehydrogenated into propylene and butene (with ultimate selectivities of propane to propylene 90%, and n-butane to n-butene of 90% and i-butane to i-butene of 90%). The ethane is subjected to steam cracking. Furthermore, the heavy part of the steam cracker effluent (C9+ hydrocarbons) is recycled to the resid hydrocracker. The ultimate conversion in the resid hydrocracker is close to completion (the pitch of the resid hydrocracker is 2 wt % of the crude).

The products that are derived from the crude oil are divided into petrochemicals (olefins and BTXE, which is an acronym for BTX+ethylbenzene) and other products (hydrogen, methane and heavy fractions comprising C9 resin feed, cracked distillate, carbon black oil and resid). The total amount sums up to 100% of the total crude, since the resid is also taken into account. From the product slate of the crude oil the carbon efficiency is determined as:

(Total Carbon Weight in petrochemicals)/(Total Carbon Weight in Crude).

Table 1 as provided herein below displays the total product slate from the steam cracker (cracked products of lights, naphtha and LPG) and from the gasoline hydrocracker (BTX product) in wt % of the total crude. The product slate also contains the pitch of the resid hydrocracker (2 wt % of the crude).

EXAMPLE 2 (COMPARATIVE)

Example 2, also according to WO 2015/000848 A1, is identical to Example 1 except that the gases fraction and the LPG produced by the various units is separated into ethane-, propane- and butane fractions which are steam cracked in dedicated steam cracker furnaces.

EXAMPLE 3

Example 3 is identical to the Example 2 except that the naphtha fraction and the light-distillates are not subjected to gasoline hydrocracking but are directly fed to the steam cracker. The C4 raffinate (remaining crude C4 produced by the steam cracker after separation of the butadiene, 1-butene and isobutene) is hydrogenated and recycled to the steam cracker as well as the C5 and C6 raffinate. The results are provided in table 1 as provided herein below.

TABLE 1

| | Example 1 (comparative) | Example 2 (comparative) | Example 3 |
|---|---|---|---|
| Petrochemicals (wt-% of crude) | | | |
| Ethylene | 20.6 | 42.1 | 42.5 |
| Propylene | 40.2 | 10.8 | 14.2 |
| Butadiene | 0.0 | 2.0 | 3.2 |
| 1-butene | 7.8 | 1.0 | 1.0 |
| Isobutene | 2.0 | 1.0 | 1.0 |
| Isoprene | 0.0 | 0.0 | 0.2 |
| CPTD | 0.0 | 0.0 | 0.9 |
| Benzene | 3.9 | 4.9 | 6.0 |
| Toluene | 7.8 | 8.8 | 5.6 |
| Xylene | 4.9 | 4.9 | 2.7 |
| Ethylbenzene | 0.0 | 0.0 | 0.8 |
| Other components (wt-% of crude) | | | |
| hydrogen | 3.9 | 2.0 | 2.2 |
| methane | 4.9 | 18.6 | 17.9 |
| Heavy components | 0.0 | 0.0 | 0.0 |
| Resid hydrocracker pitch | 2.0 | 2.0 | 2.0 |
| Carbon efficiency | 93.2 | 80.6 | 83.7 |

The invention claimed is:

1. A process to convert crude oil into petrochemical products comprising crude oil distillation, hydrocracking and steam cracking, which process comprises the steps of:

(a) subjecting the crude oil to crude oil distillation to produce gases fraction, naphtha, kerosene, gasoil and resid;

(b) subjecting resid to resid upgrading to produce LPG, light-distillate and middle-distillate;

(c) subjecting at least a portion of one or more of the group consisting of middle-distillate produced by resid upgrading, kerosene and gasoil to middle-distillate hydrocracking to produce LPG, light-distillate and hydrowax; and (d) subjecting at least a portion of one or more of the group consisting of light-distillate produced by resid upgrading, light-distillate produced by middle-distillate hydrocracking and hydrowax to steam cracking;

wherein the resid upgrading is conducted in a resid upgrading unit selected from the group consisting of a resid FCC, a Flexicoker, a visbreaker and a catalytic hydrovisbreaker.

2. The process according to claim 1, wherein the resid upgrading unit is a resid FCC.

3. The process according to claim 2, wherein the middle-distillate hydrocracking further produces a heavy-distillate, wherein at least a portion of said heavy-distillate produced by middle-distillate hydrocracking is subjected to resid upgrading.

4. The process according to claim 1, wherein the middle-distillate hydrocracking further produces a heavy-distillate, wherein at least a portion of said heavy-distillate produced by middle-distillate hydrocracking is subjected to resid upgrading.

5. The process of claim 4, wherein the resid upgrading unit is a resid FCC.

6. The process of claim 4, wherein the resid upgrading unit is a Flexicoker.

7. The process of claim 4, wherein the resid upgrading unit is a visbreaker.

8. The process of claim 4, wherein the resid upgrading unit is a catalytic hydrovisbreaker.

9. The process of claim 1, wherein the resid upgrading unit is a Flexicoker.

10. The process of claim 1, wherein the resid upgrading unit is a visbreaker.

11. The process of claim 1, wherein the resid upgrading unit is a catalytic hydrovisbreaker.

12. The process of claim 1, wherein in step (c) only LPG and light-distillate are produced.

13. The process of claim 1, wherein at least a portion of the hydrowax is subjected to steam cracking.

14. A process to convert crude oil into petrochemical products comprising crude oil distillation, hydrocracking and steam cracking, which process consists of the steps of:

(a) subjecting the crude oil to crude oil distillation to produce gases fraction, naphtha, kerosene, gasoil and resid;

(b) subjecting resid to resid upgrading to produce LPG, light-distillate and middle-distillate;

(c) subjecting at least a portion of middle-distillate produced by resid upgrading, at least a portion of kerosene and gasoil to middle-distillate hydrocracking to produce LPG, light-distillate and hydrowax; and (d) subjecting at least a portion of light-distillate produced by resid upgrading, light-distillate produced by middle-distillate hydrocracking and hydrowax to steam cracking, wherein the resid upgrading is conducted in a resid upgrading unit selected from the group consisting of a resid FCC, a Flexicoker, a visbreaker and a catalytic hydrovisbreaker.

15. A process to convert crude oil into petrochemical products comprising crude oil distillation, hydrocracking and steam cracking, which process consists of the steps of:

(a) subjecting the crude oil to crude oil distillation to produce gases fraction, naphtha, kerosene, gasoil and resid;

(b) subjecting resid to resid upgrading to produce LPG, light-distillate and middle-distillate;

(c) subjecting at least a portion of the middle-distillate produced by resid upgrading to middle-distillate hydrocracking to produce products consisting of LPG and light-distillate; and (d) subjecting at least a portion of one or more of the group consisting of light-distillate produced by resid upgrading, light-distillate produced by middle-distillate hydrocracking and hydrowax to steam cracking, wherein the resid upgrading is resid hydrocracking, wherein the middle-distillate hydrocracking further produces a heavy-distillate, wherein at least a portion of said heavy-distillate produced by middle-distillate hydrocracking is subjected to resid upgrading; and wherein the resid upgrading is conducted in a resid upgrading unit selected from the group consisting of a resid FCC, a Flexicoker, a visbreaker and a catalytic hydrovisbreaker.

16. The process of claim 15, wherein the resid upgrading unit is a resid FCC.

17. The process of claim 16, wherein the resid upgrading unit is a Flexicoker.

18. The process of claim 16, wherein the resid upgrading unit is a visbreaker.

19. The process of claim 16, wherein the resid upgrading unit is a catalytic hydrovisbreaker.

* * * * *